United States Patent [19]

Belotti

[11] 4,299,113

[45] Nov. 10, 1981

[54] APPARATUS FOR BENDING TUBES OR BARS AND MOTOR-PUMP UNIT THEREFOR

[75] Inventor: Giovanni Belotti, Agrate Brianza, Italy

[73] Assignee: L. ID. IT Lattoneria Idrotermica Italiano dei Fratelli Belotti, Milan, Italy

[21] Appl. No.: 17,300

[22] Filed: Mar. 5, 1979

[30] Foreign Application Priority Data

Apr. 24, 1978 [IT] Italy ..... 22652 A/78

[51] Int. Cl.[3] ..... B21D 7/06

[52] U.S. Cl. ..... 72/389; 60/468; 72/453.16

[58] Field of Search ..... 72/389, 386, 453.01, 72/453.16, 453.15; 60/468, 494

[56] References Cited

U.S. PATENT DOCUMENTS

| | | | |
|---|---|---|---|
| 2,867,261 | 1/1959 | Traupmann | 72/389 |
| 2,998,838 | 9/1961 | Byrd | 72/389 |
| 3,213,605 | 10/1965 | Welden | 60/481 |
| 3,344,635 | 10/1967 | Van Allen | 72/389 |
| 3,620,066 | 11/1971 | Henkel | 72/389 |
| 4,055,069 | 10/1977 | Caporusso | 72/453.16 |

FOREIGN PATENT DOCUMENTS

| | | | |
|---|---|---|---|
| 458280 | 2/1943 | Canada | 60/468 |
| 459023 | 8/1950 | Italy | 72/389 |

*Primary Examiner*—Gene P. Crosby

*Attorney, Agent, or Firm*—Wolder, Gross & Yavner

[57] ABSTRACT

An apparatus for bending and/or curving tubes or bars, comprises bearings for the tube or bar to be curved or bent. The said bearings arranged on a support having a handle extending therefrom and enclosing an axially movable stem. A fluid, which is furnished by a pump being enclosed within a container for the collection of the tool operating fluid in a closed circuit also passing continuously through said handle, the flowing speed of said fluid being adjustable by means of a throttling member. The resulting increase in fluid pressure, as built up upstream of the throttling, being used for a stem feeding pressure, with subsequent bending and/or curving operation.

8 Claims, 7 Drawing Figures

APPARATUS FOR BENDING TUBES OR BARS AND MOTOR-PUMP UNIT THEREFOR

This invention relates to an apparatus for bending and/or curving tubes or bars, particularly tubes used for heating systems or plants as being laid down in the seats thereof.

The invention is also concerned with a remote operable motor-pump unit intended for the above mentioned apparatus.

Machines and apparatus for tube or bar bending have been already known. However, such machines are generally of a considerable weight, that is undue to be usable in bending works to be carried out in situ. Additionally, the prior art motor-pump units are unsuitable for easy hand transportation. Further they are not suitable to be used in subjecting small amounts of oil to the operating pressure of about 130 bars and cannot be connected and/or disconnected by a drive carried on the apparatus or tool.

It is the object of the invention to provide an apparatus for bending and/or curving steel or copper tubes of any length, particularly tubes for heating systems or plants as being laid down in the respective seats previously preformed in the walls or floors.

It is a further object of the invention to provide an apparatus which is operable by means of a fluid in the form of oil and fitted with means enabling a sensitive adjustment of the heading tool feed and which can be also gripped and operated by only one hand, leaving the other hand free in guiding the tube to be curved or bent.

According to the invention, this object is achieved in that the apparatus according to the invention comprises bearings for the tube to be curved or bent, which are prearranged on a support, the latter having a handle extending therefrom, which encloses an axially displaceable stem for bending and/or curving of adjustable angular extension, further wherein a fluid in a closed circuit continuously passes through said handle, the flowing speed of such a fluid being adjustable by means of a clogging or throttling member, the resulting increase in fluid pressure, as built up downstream of the throttling being used for a stem feeding pressure.

Additionally, it is an object of the invention to provide a motor-pump unit for the above mentioned apparatus, which can be remote connected and/or disconnected by the same hand holding the apparatus.

The motor-pump unit is characterized in that the pump is enclosed within a housing or container for collecting the tool operating fluid to form therewith a closed delivery and return circuit, the electric motor being preset to overlap said pump which can be connected and/or disconnected by a switch means or the like, as mounted on the tool and substantially simultaneously operable with the tool drive means.

For a better illustration, the accompanying drawings show a preferred unrestrictive embodiment of the invention, and more particularly:

FIG. 1 is a partly sectional view showing the apparatus or tool;

FIG. 1*a* is an enlarged fragmentary detailed longitudinal sectional view of a portion of the apparatus shown in FIG. 1;

FIG. 1*b* is a transverse sectional view of a portion thereof;

FIG. 1*c* is a partially longitudinal view of the valve section shown in FIG. 1*b;*

Figure 1:
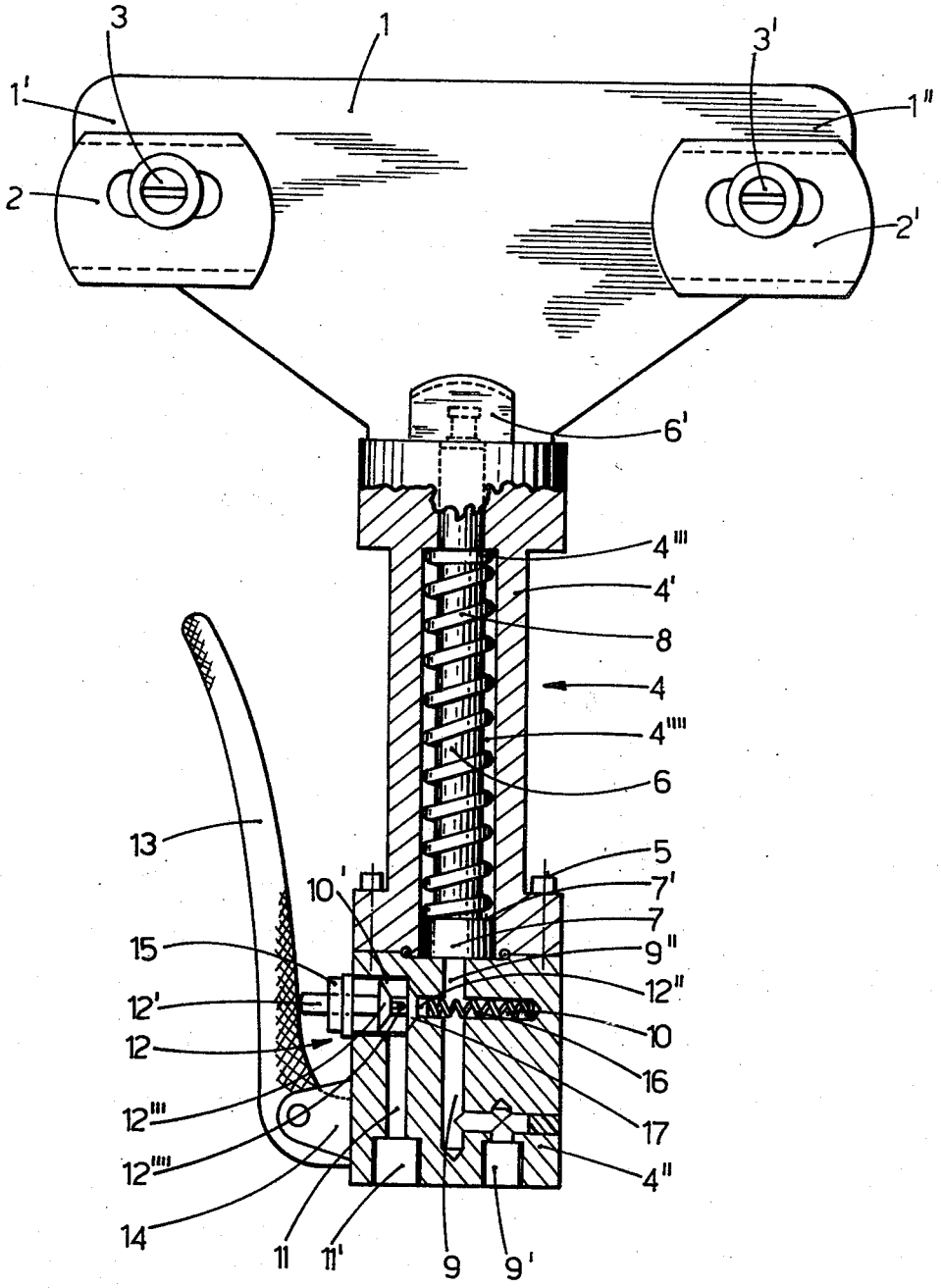
Figure 1A:
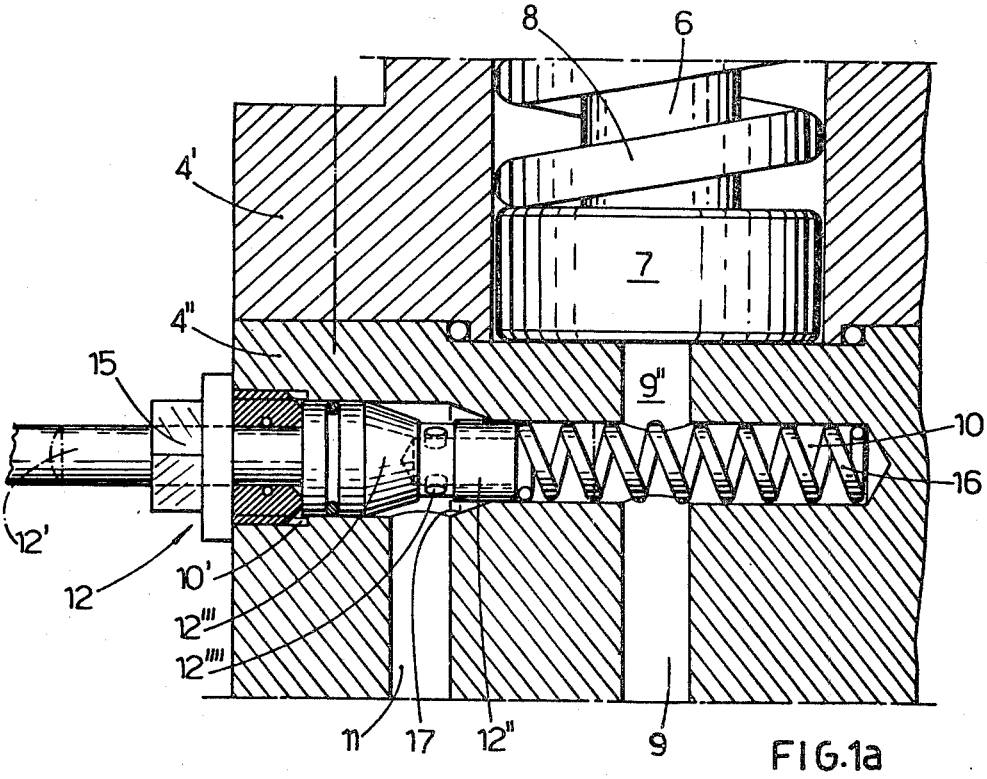
Figure 1B:
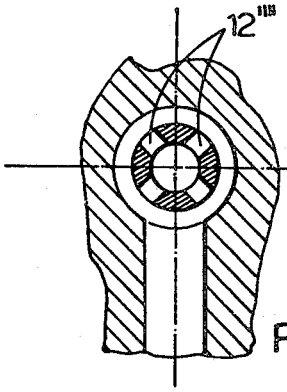
Figure 1C:
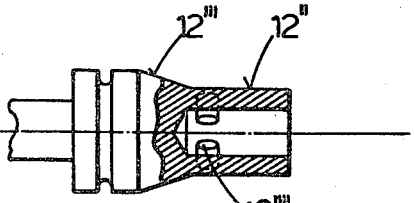

The apparatus comprises a base 1 provided at its ends 1' and 1'' with a bearing 2, 2' for the tube to be bent, rotable and displaceable relative to the supporting pins thereof 3, 3' integral with said base.

Said base 1 is also provided with a handle 4, actually made in two parts or pieces, of which a first top part or piece 4' is integral with base 1, and the second bottom part or piece 4'', substantially coaxial with the first part, is secured to said first part, such as by means of screws 5. Said first part 4' of the handle accomodates therein a stem 6 provided with a plunger 7, the stem portion opposite to plunger 7 being configurated to allow the securing of a head 6' which, as a heading tool or punch under the action of an outward axial displacement of stem 6 is, in turn, effective on the tube previously preset in the respective bearings 2, 2'.

A compression spring 8 rest on the annular base 7' of plunger 7, this spring having been pretensioned and pressing with its other end against a base 4''' at the top end of the cylindrical recess or cavity 4'''' in the handle.

The second bottom part 4'' of the handle comprises the conduits 9 and 11 which are substantially parallel to each other and provided with respective threaded holes 9' and 11' for the fastening of inlet and outlet hoses, respectively, of a liquid fluid or in the case also compressed air, which is preferably continuously and in closed circuit delivered by means of a pump.

Prior to reaching the base of plunger 7, said conduit 9 intersects or in any case connects with a conduit 10, which is substantially perpendicular to conduits 9 and 11 and, in turn, communicates with the fluid outlet conduit 11. A valve 12 is located within the threaded hole 10' coaxial with the last mentioned conduit 10, this valve 12 being axially displaceable under the action of a lever 13, in turn pivoted to a support 14, integrally formed with said second part 4'' of the handle, which lever 13 acts upon the valve stem 12' axially slidable with respect to a sleeve 15.

Said valve or throttle member 12, capable of providing an actual flow obstruction, is subjected to the action of a compression spring 16, which is housed within said cylindrical conduit 10, the latter also serving, in turn, as a guide for the outer portion 12' of the valve provided with through holes 12'''', and this at whatever axial displacement position thereof. Finally, said valve 12 has a suitably frusto-conical cap 12''', quite adaptable to a seat 17 formed in the second part of the handle.

The operation of the apparatus or tool is as follows.

When the apparatus or tool is at rest or inoperatives position, the fluid collected in a suitable container or tank freely circulates under the action of a pump within the path comprising the inlet and outlet tubes (not shown in the drawing) and conduits 9, 10 and 11, at the same time arriving at the plunger base along the extreme portion 9'' of conduit 9. For a free circulation of the fluid that, referring to conduit 10, flows in an axial direction about spring 16, the cylindrical portion 12'' guiding the valve is provided with through holes 12'''' of the required cross-section to assure a free fluid flow or passage at any rotational position of the valve.

When in said fluid path the flow speed or circulation is reduced or even shut off due to feeding or forward movement of valve 12 as a result of operation of lever 13, said plunger 7 together with head 6', as preset forwardly of valve 12, is outwardly urged as a result of an increase in pressure occurring downstream of said valve.

Figure 2:
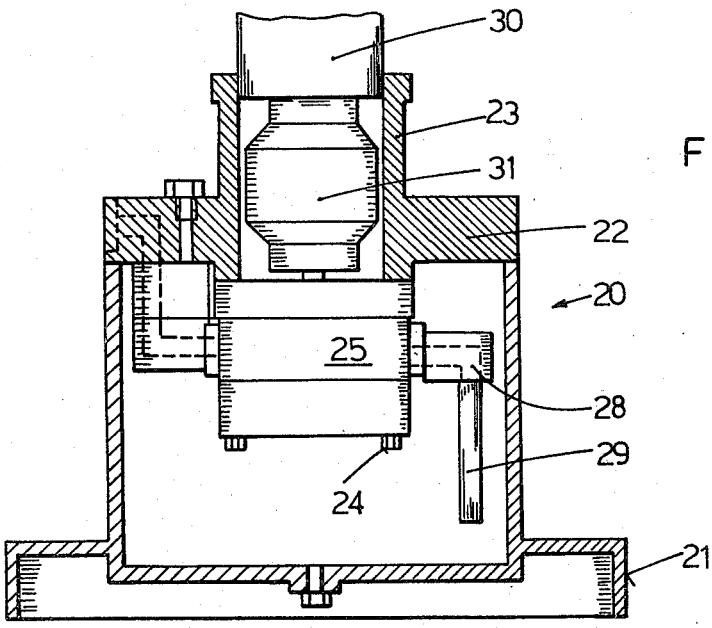
FIG. 2 is a vertical sectional view showing the motor-pump unit.
Figure 3:
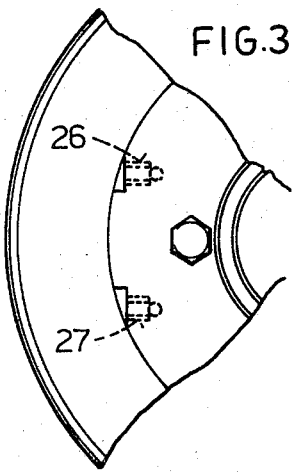
FIG. 3 is a top view showing a portion of said unit, particularly referring to the fluid inlet and outlet connectors.
Figure 4:
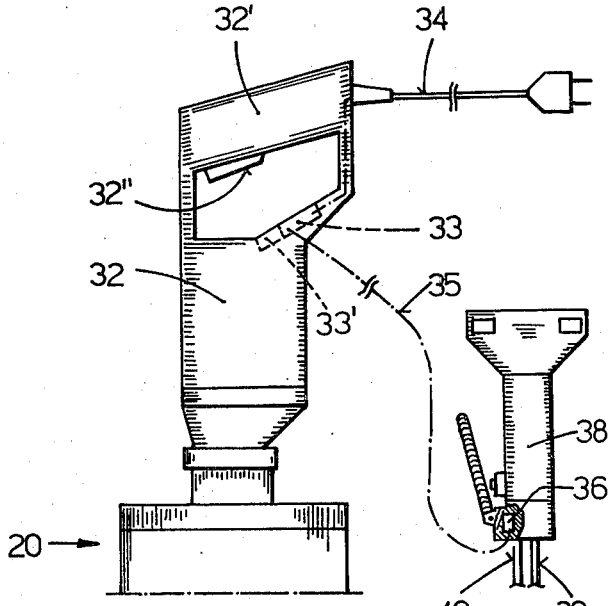
FIG. 4 is a diagrammatic view showing the unit as connected to the remote driving means mounted on the apparatus or tool.

Referring to FIGS. 2, 3 and 4, the motor-pump unit provided for the above mentioned apparatus or tool comprises a container-like structure 20, provided with a base 21 and cover or lid 22, overlapped by a neck 23. At the bottom of cover or lid 23 a pump 25 is steadily mounted by means of screws 24, at inoperative condition said pump being at least partially immersed in the fluid, preferably oil, and having an inlet connector 26 (FIG. 3) and an outlet connector 27, respectively, as well as an aperture 28 (FIG. 2) provided with a small tube for fluid suction from the container bottom.

An adjustable maximum pressure safety valve is provided in the hydraulic circuit, as applied to the pump outlet and preferably located within the container.

The above mentioned neck element 23 is for the assembling of motor 30 overlapping said structure. The drive shaft transmission stress is transmitted to the pump shaft through the interposition of a coupling, preferably an elastic coupling 31.

According to a preferred embodiment, said motor 30 comprises a substantially well known type of electric hand drilling machine 32 (FIG. 4). This drilling machine has mounted in its handle 32', conveniently serving for unit hand transportation, an electronic type of additional control assembly 33, and encloses therein a transformer 33'. A cable or wire 34, connectable to the electric voltage network, as well as a wire 35 for connection to a reduced overall size and low voltage operating switch means 36, are connected to said control assembly 33. Conveniently, said switch means 36 is located between the operating level 37 and the tool handle 38, so that upon operation of lever 37, the latter substantially simultaneously acts upon the pump motor, whereby such a pump is connected and/or disconnected. The wire 35 may be a flexible push-pull transmission operated by lever 37 for controlling assembly 33 or may be a hydraulic transmission tube likewise operated by lever 37 for controlling assembly 33 as aforesaid.

According to a further embodiment, said switch 36 or remote control means for the pump is provided for mounting at any other part of said handle, provided that it is always readily reachable for its operation by the same hand holding the tool or apparatus. In addition to wire 35, two hoses 39 and 40 (see FIG. 4) respectively for fluid delivery and return can be connected to said tool or apparatus, such hoses being connected by the other end thereof to the above mentioned connectors 26 and 27 of pump 25.

The transformer 33' serves the purpose of lowering the voltage for the motor control, such a voltage being supplied from the electric mains or power line at the voltage of 6 volts, preferably 3 volts, thus assuring the highest safety for an operator.

The remote switch is provided for application in addition to any part of the handle also at any part of said motor-pump unit and independently of the provision of said control lever 13. When, for example, the motor unit is preset in the operator's hand range, or when a failure occurs in said switch 36, or in the electronic control 33 mounted in the handle 32' of the electric drilling machine, the operation of the unit and tool therewith is of course assured by the provision of the lever switch 32'', which the commercially available hand drilling machines are provided with.

Advantageously, the electric motor comprises an electric hand drilling machine, which through slight modifications can be adapted to the motor unit. Preferably, the application is provided for a drilling machine which through the interposition, for example, of a resilient coupling can be releasbly attached to the collar 23 or cover 22 by means of well known fastening means.

Particularly referring to FIG. 4, the remote operating means for said motor-pump unit comprise a reduced overall size switch 36, which is located between the control lever 37 and handle 38 of said apparatus or tool. It is accordingly apparent that starting for the pump motor unit substantially occurs at the same time as lever operation, whereas the disconnection of said unit is automatically carried out when, under the action of a spring, said lever is returned to its original position.

Finally, as remote operating means for the motor, the use is provided of per se well known type of hydrostatic members which, preferably under the action of control lever 13 or 37, the wire 35 being a hydraulic fluid transmission tube on the apparatus or tool, compress a certain amount of fluid sufficient to operate a switch and that, in such a case, is conveniently arranged on said motor unit. According to a further embodiment, a per se known type of remote control is provided, as comprising a flexible means or element capable of being subjected both to traction and compression and being represented in FIG. 4 of the drawings by the reference numeral 35, and which as operated by said lever will act upon the switching means of the pump operating motor. At last, a remote electronic control would do. Finally an electrovalve could be used, preferably mounted on the tool discharge piping, and which can be remote controlled by means of a pushbutton provided on the apparatus or tool handle.

What is claimed is:

1. An apparatus for bending tubes or bars, comprising bearings for a tube to be curved or bent, a support carrying said bearings and having a handle extending therefrom with a bore therein enclosing an axially movable stem, means continuously circulating a fluid in a closed circuit through a passageway in the free end portion of said handle, a throttle member including an axially bored cylindrical outer portion having a through hole (12'''') therein and said outer portion (12'') including a valve stem for adjusting the pressure of such a fluid by adjustably varying the opening of said through hole (12''''), the resulting increase of pressure of said fluid as built up upstream of said throttling member being used for exerting an adjustable advancing pressure on the stem (6).

2. An apparatus according to claim 1, wherein a bore fluid inlet passageway is formed in said handle communicating perpendicularly with a passageway (10) which communicates with the bore in said outer portion (12'') of the throttling member and said passageway (10) communicates with a fluid outlet (11) from the handle.

3. An apparatus according to claim 1, including a compression spring (16) biasing said throttle member (12) to its open condition and a lever for variably actuating the throttle member for adjustably controlling its opening and resistance to fluid flow, said compression spring being accommodated within said passageway (10) and guiding the outer portion (12'') of the throttle member, the advancement of the throttle member for the control and obstruction of the fluid passage occurring axially and in the opposite direction to that of the free circulating fluid in said passageway.

4. A motor-pump unit for the fluid supply to a fluid motivated apparatus, wherein the pump is enclosed within a container for the collection of the apparatus operating fluid and the apparatus is activated by a control lever, characterized by the inclusion of an electric motor powered hand drill mounted on the container and drive coupled to said pump, and means for controlling the energization of the motor including a switch of its own (32″) or switch means (36) carried on said apparatus, which switch means (36) is operable substantially concurrently with the actuation of the apparatus by the apparatus operating lever (37).

5. A motor-pump unit according to claim 4, wherein said operating switch means (36) is mounted independently of said operating lever.

6. For use with a pressurized fluid driven apparatus including a manually controlled valve located at the apparatus, a pumping unit comprising a fluid reservoir, a pump mounted in said reservoir, an electric motor powered hand drill externally mounted to said reservoir and drive coupled to said pump, said pump, reservoir and apparatus being in fluid communication and means including a drill motor switch and actuated by means which controls said value for controlling the energization of said motor in accordance with the actuation of said switch.

7. A tube or bar shaping apparatus comprising a support member, a pair of transversely spaced work piece bearing members located on said support member, a longitudinally extending handle member mounted on said support member and longitudinally offset and located transversely between said bearing members and having a cylinder defining a longitudinal bore formed therein, said handle member having a fluid passageway formed therein extending between an inlet and an outlet and communicating at a predetermined point between said inlet and outlet with said cylinder, a piston longitudinally slidably disposed in said cylinder, a shaping member coupled to and movable with said piston, means for circulating a hydraulic fluid through said passageway in a direction from said inlet to said outlet, a variable opening throttle valve located in said passageway between said outlet and said predetermined point whereby the fluid pressure in said cylinder is a function of the back pressure effected by the size of the variable opening of said valve, manually operable means located on said handle member for controlling said throttle valve to control the fluid pressure in said cylinder, said fluid circulating means being remote from said support member and including a fluid reservoir, a pump having an inlet communicating with said fluid reservoir and an outlet communicating with said passageway inlet, said passageway outlet communicating with said reservoir and an electric motor in drive connection with said pump and further comprising means for controlling the energization of said motor including a control switch carried with said support member.

8. The apparatus of claim 7, wherein said switch is actuated in response to the operation of said valve control means.

* * * * *

UNITED STATES PATENT AND TRADEMARK OFFICE

CERTIFICATE OF CORRECTION

PATENT NO. : 4,299,113

DATED : November 10, 1981

INVENTOR(S) : Giovanni Belotti

It is certified that error appears in the above-identified patent and that said Letters Patent is hereby corrected as shown below:

On the title page, assignee address should read

-- Agrate Brianza, Italy --

Signed and Sealed this

Ninth Day of November 1982

[SEAL]

*Attest:*

GERALD J. MOSSINGHOFF

*Attesting Officer*

*Commissioner of Patents and Trademarks*